US005112033A

United States Patent [19]

Breton

[11] Patent Number: 5,112,033

[45] Date of Patent: May 12, 1992

[54] FOLDER APPARATUS FOR A WEB-FED PRINTING PRESS

[75] Inventor: Richard E. Breton, Rochester, N.H.

[73] Assignee: Harris Graphics Corporation, Dover, N.H.

[21] Appl. No.: 782,757

[22] Filed: Oct. 21, 1991

Related U.S. Application Data

[63] Continuation of Ser. No. 521,263, May 9, 1990, abandoned.

[51] Int. Cl.[5] ..... B42C 1/00

[52] U.S. Cl. ..... 270/47; 270/60; 271/315

[58] Field of Search ..... 270/39, 13, 47, 60; 271/302, 314, 315

[56] References Cited

U.S. PATENT DOCUMENTS 3,607,583 9/1971 Geschwender ..... 270/39

FOREIGN PATENT DOCUMENTS 441782 9/1923 Fed. Rep. of Germany ..... 270/39

1408247 7/1965 France ..... 270/39

*Primary Examiner*—Edward K. Look

*Assistant Examiner*—Therese M. Newholm

*Attorney, Agent, or Firm*—Herbert L. Lerner; Laurence A. Greenberg

[57] ABSTRACT

A folder apparatus of a web-fed printing press having a printed-product delivery with two fan arrangements, each of which is formed of a plurality of mutually adjacent fans spaced-apart from one another on a common axis, the respective common axis of each of the two fan arrangements being disposed parallel to the common axis of the other, each of the fans of one of the fan arrangments being disposed adjacent to an in a respective common plane with a respective one of the fans of the other of the fan arrangements, each of the fans being formed with blades having tips located at a circumference of the respective fan, the circumference of the fans in the respective common plane intersecting with one another, and a device provided on the fans for preventing a collision of respective blade tips of the fans disposed in the respective common plane.

22 Claims, 8 Drawing Sheets

FOLDER APPARATUS FOR A WEB-FED PRINTING PRESS

This application is a continuation, of application Ser. No. 521,263, filed May 9, 1990.

The invention relates to a folder apparatus for a web-fed printing press and, more specifically, to a folder apparatus located downstream of the printing press in the direction of travel of a printed product.

After a paper web, which has been fed through a web-fed rotary printing press, is printed, it is fed to a folder apparatus wherein processing of the printed products (folding, cutting and separating) occurs.

A focal point of the invention is concerned with a printed product delivery system which permits the printed product stream conducted through the folder apparatus to divide into a plurality of printed product streams for the purpose of delivering the printed product.

The printed product delivery is effected by means of one or more contra-revolving assemblies such as fan assemblies or arrangements which take up the printed product and deposit it on a conveyor belt for further processing.

In U.S. Pat. No. 3,894,479, a method of forming piles of newspapers is disclosed. Two fan arrangements are provided to which printed products are alternatingly fed. The allocation of the individual printed products to one of the fan arrangements is effected via a diverter which is disposed upstream of the fan arrangements in the flow direction of the printed products.

In U.S. Pat. No. 3,762,697, many embodiments of a delivery mechanism for printed products are shown and described. Fan arrangements for a printed product delivery system are also disclosed therein for permitting division of the printed product stream passing through the folder apparatus.

These heretofore known fan arrangements are of the construction type wherein several identical fans are arranged at a spaced distance from one another along a common axis.

According to the last-mentioned patent, two fan arrangements can be provided with respect to one printed product stream, the fan arrangements, respectively, having a printed product alternatingly fed thereto. In contrast with U.S. Pat. No. 3,894,479, no diverter for channeling the printed product stream to the two fan arrangements is provided in U.S. Pat. No. 3,762,697. The spacing between the mutually opposing axes of the fan arrangements in the latter patent is smaller than the diameter of each of the identical fan arrangements. The paddles of the first fan arrangement are arranged so as to be offset laterally from the paddles of the second fan arrangement, so as to prevent any collision of the oppositely disposed paddles. The feed of the printed products occurs in the middle between the parallel axes of the fan arrangements.

In accordance with the respective setting of a fan arrangement, the first or the second fan arrangement can take over the oncoming printed product and deliver it.

A disadvantage of the latter construction is that the printed product virtually drops in a free fall without guidance into the respective paddles of a fan arrangement. Such printed products falling without guidance can, for example, pass between the paddles of the fan arrangements which are disposed axially offset from one another or can become jammed between the paddles, which results in damage to the printed product.

It is an object of the invention. accordingly, to avoid the foregoing disadvantage of heretofore known arrangements of this general type and to optimize sheet guidance therethrough.

With the foregoing and other objects in view, there is provided, in accordance with the invention, a folder apparatus for a web-fed printing press having a printed-product delivery, comprising two assemblies, respectively, revolvable in opposite directions and including respective receiving means formed with pockets for receiving a printed product therein, the respective receiving means of each of the assemblies being displaceable along respective endless paths as the assemblies revolve, the receiving means of both of the assemblies being on a collision course with one another so as to be collidable at a given location of the endless paths, and collision-preventing means included in each of the assemblies for preventing a collision at the location between the receiving means in one of the assemblies and the receiving means in the other of the assemblies.

In accordance with another aspect of the invention, a folder apparatus of a web-fed printing press having a printed-product delivery is provided, comprising two fan assemblies, respectively, formed of a rotatable body having a substantially cylindrical configuration and having respective rotational axes disposed alongside and spaced from one another, each of the fan arrangements being formed with a multiplicity of blades having tips located at a circumference of the respective fan arrangement, respective mutually adjacent pairs of the blades defining therebetween a pocket for receiving a printed product therein, the rotational axes being spaced a distance from one another which is less than the sum of the radii of the cylindrically configured rotatable bodies so that the circumferences thereof mutually intersect, the fan assembly having means for preventing the respective blade tips of the fans from colliding.

In accordance with another aspect of the invention, each of the two fan arrangements is formed of a plurality of mutually adjacent fans spaced-apart from one another on a common axis, the respective common axis of each of the two fan arrangements being disposed parallel to the common axis of the other, each of the fans of one of the fan arrangements being disposed adjacent to and in a respective common plane with a respective one of the fans of the other fan arrangements, each of the fans being formed with blades having tips located at a circumference of the respective fan, the circumferences of the fans in the respective common plane intersecting with one another, and means provided on the fans for preventing a collision of respective blade tips of the fans disposed in the respective common plane.

The arrangement of the opposing fans to one another offers many advantages with respect to paper transport and handling of the individual products processed in the folder apparatus, respectively. Thus, by the arrangement of the fans it is possible also to guide reliably folded products, such as four-page signatures, for example, which are problematic i.e. thin, light, small-formatted or open at the leading edge thereof, which tend to flutter during transport (especially at very high speeds).

A folded product which is taken up by the blades of one of the fan assemblies is thus lifted away from the product stream by the succeeding blade tips of the opposing other fan assembly, and additionally displaced in the direction of the first-mentioned fan assembly. A minimum spacing, if necessary or desirable, is thereby produced advantageously between the folded products in the product stream, because the following printed products can then be ideally taken up immediately from the next fan assembly. Furthermore, the folded product can additionally be stabilized.

In accordance with a more specific feature of the invention, the blades of the fans are formed with recesses at a radially outer region thereof, for receiving therein the tips of the blades of the fans disposed therewith in the respective common planes.

In accordance with an added feature of the invention, the blades are formed with a given curvature, and the collision preventing means include a resilient covering for the respective recess formed in the blades, the resilient covering having substantially the same curvature as the given curvature of the respective blade and being movable into the respective recess. The advantage deriving from this feature is that the folded product, during the stripping process i.e. when it is stripped from the fan assembly, is not hindered by or caught in the recesses.

In accordance with more detailed features of the invention, the resilient covering is a leaf-spring element.

In accordance with further detailed features of the invention, the recess has its greatest depth closest to a free end of the respective blade tip and is formed with an undercut portion thereat, the leaf-spring element being fixed to the respective blade tip at a location of the recess farthest from the free end of the respective blade tip and having, in turn, a free end yieldingly received in the undercut portion of the recess.

In accordance with an additional feature of the invention, the recess is formed in only one side of each of the respective blades of the fan, and the tip of each of the respective blades of the other fan is correspondingly formed so as to be accommodated in the recess.

In accordance with yet another feature of the invention, the recess has a depth which is a fraction of the thickness of the blade, and an outermost part of the tips of the blades has a reduced thickness substantially corresponding to the depth of the recess so as to afford a contact-free passage of the outermost parts of the tips of the blades, respectively, through the recess. Thus, the recesses are formed in only part of the thickness of the blade tips and sufficient clearance between the defining surfaces of the recesses and the corresponding tip portions of reduced thickness permit a trouble-free interengagement of the opposing fans.

In accordance with even more specifically detailed features of the invention, respective pairs of the blades of the fans define pockets therebetween for receiving printed products therein, and the folder apparatus includes means for successively feeding a stream of cut printed products directly to the fan assemblies, the feeding means comprising tape rollers carrying transport tapes and including lowermost tape rollers projecting downwardly into the fans for effecting a positive, high-speed placement of the printed products into the respective pockets.

In accordance with yet a further feature of the invention, the blades have a slide-resistant material (such as foamed material or the like) thereon for braking an oncoming printed product. Due to this feature, the folded product can be additionally braked, in an advantageous manner, the instant the tip of the respective opposing fan comes into contact with the printed product.

In accordance with yet an additional feature of the invention, the tips of the blades of one of the fan arrangements are movable towards and away from the tips of the blades of the other of the fan arrangements.

In accordance with yet an added feature of the invention, a slide-resistant material is disposed in the pockets for the printed product so as to effect a braking of the printed product therein, in an advantageous manner.

In accordance with an alternate feature of the invention which avoids the necessity for forming recesses in the blades or for correspondingly forming the tips of the blades which are to be accommodated in the recesses, at least a portion of the tips of the blades is movably disposed on the blades, and means are provided for actuating the movable portion of the tips. Thus, a collision of a respective tip with a stripping location at which a signature is being stripped from an assembly can be avoided because the approaching tips located within the overlapping region of the circumference of the fan arrangements can be moved or swivelled away.

In accordance with another aspect of the invention, there is provided, in a folder apparatus of a web-fed printing press, a printed product delivery comprising two fan assemblies, respectively, formed of a rotatable body having a substantially cylindrical configuration; and means for successively delivering a stream of cut printed products directly to the fan assemblies, the rotatable bodies having respective rotational axes disposed alongside and spaced from one another a distance less than the sum of the radii of the substantially cylindrically configured bodies so that a mutually overlapping region of the circumferences of the bodies is formed, each of the fan assemblies having a multiplicity of blades defining pockets therebetween for receiving printed products therein and being formed with respective tips extending into the overlapping region of the circumferences for diverting the printed products directly delivered to the fan assemblies alternatingly into a pocket of the one fan assembly and into a pocket of the other fan assembly, and means formed on the fan assemblies for preventing the respective blade tips from colliding.

In accordance with a further feature of the invention, the blade tips are pivotally connected to the blades, and including means for alternatingly pivoting the blade tips, respectively, out of the mutually overlapping region of the circumferences so as to prevent collision between the respective blade tips of the respective fan assemblies.

In accordance with a concomitant aspect of the invention, there is provided a folder apparatus of a web-fed printing press having a printed product delivery comprising two fan assemblies, respectively, formed of a rotatable body having a substantially cylindrical configuration and having respective rotational axes disposed parallel to one another, each of the fan assemblies being formed with a multiplicity of blades having tips located at a circumference of the respective fan assembly, respective mutually adjacent pairs of the blades defining therebetween a pocket for receiving a printed product therein, the rotational axes being spaced a distance from one another which is less than the sum of the radii of the substantially cylindrically configured rotatable bodies so that the circumferences mutually intersect, the fan assemblies having means for preventing the respective blade tips of the fans from colliding.

Other features which are considered as characteristic for the invention are set forth in the appended claims.

Although the invention is illustrated and described herein as embodied in a folder apparatus for a web-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
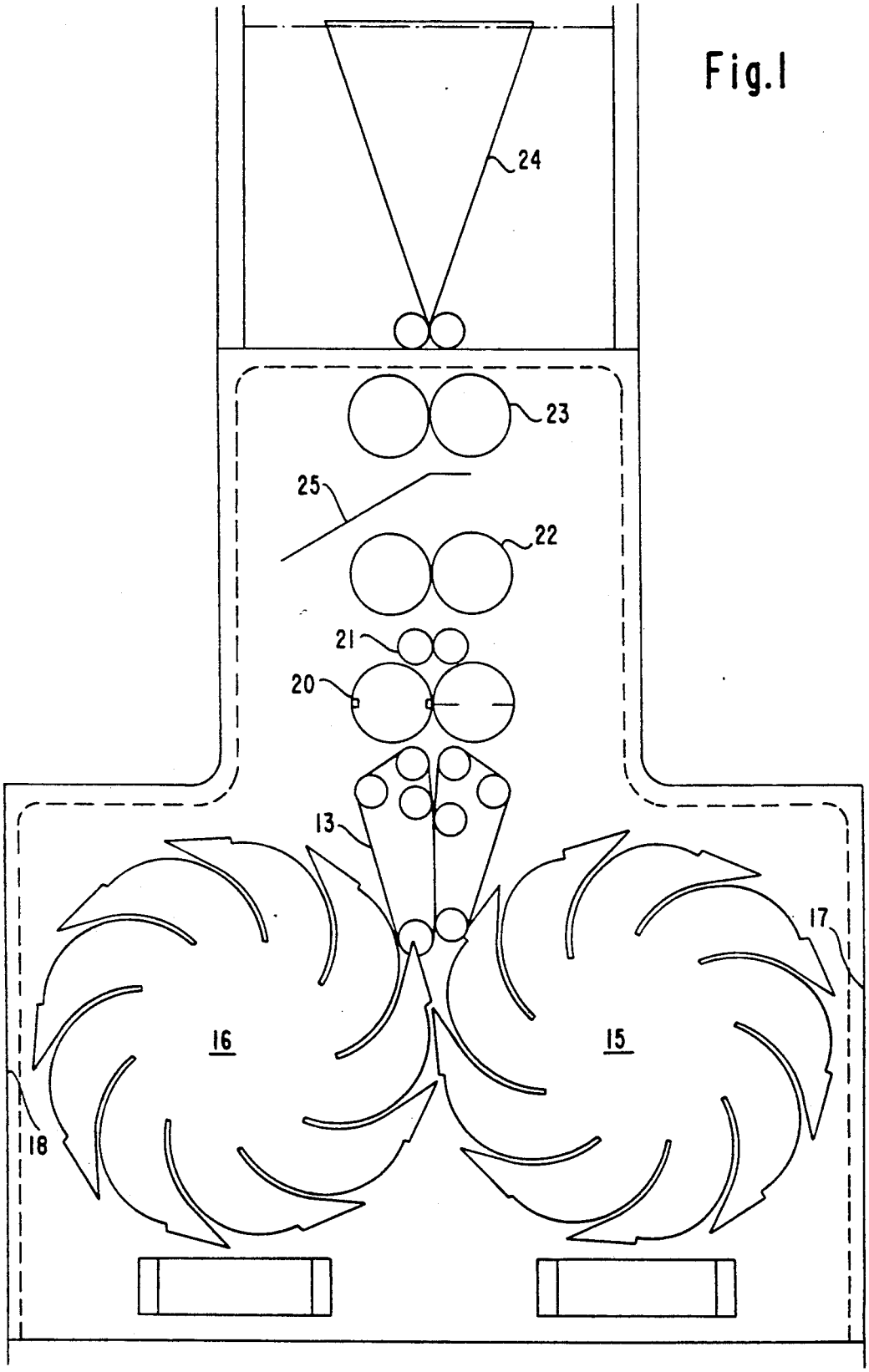
FIG. 1 is a diagrammatic front elevational view of a folder apparatus constructed in accordance with the invention.
Figure 2:
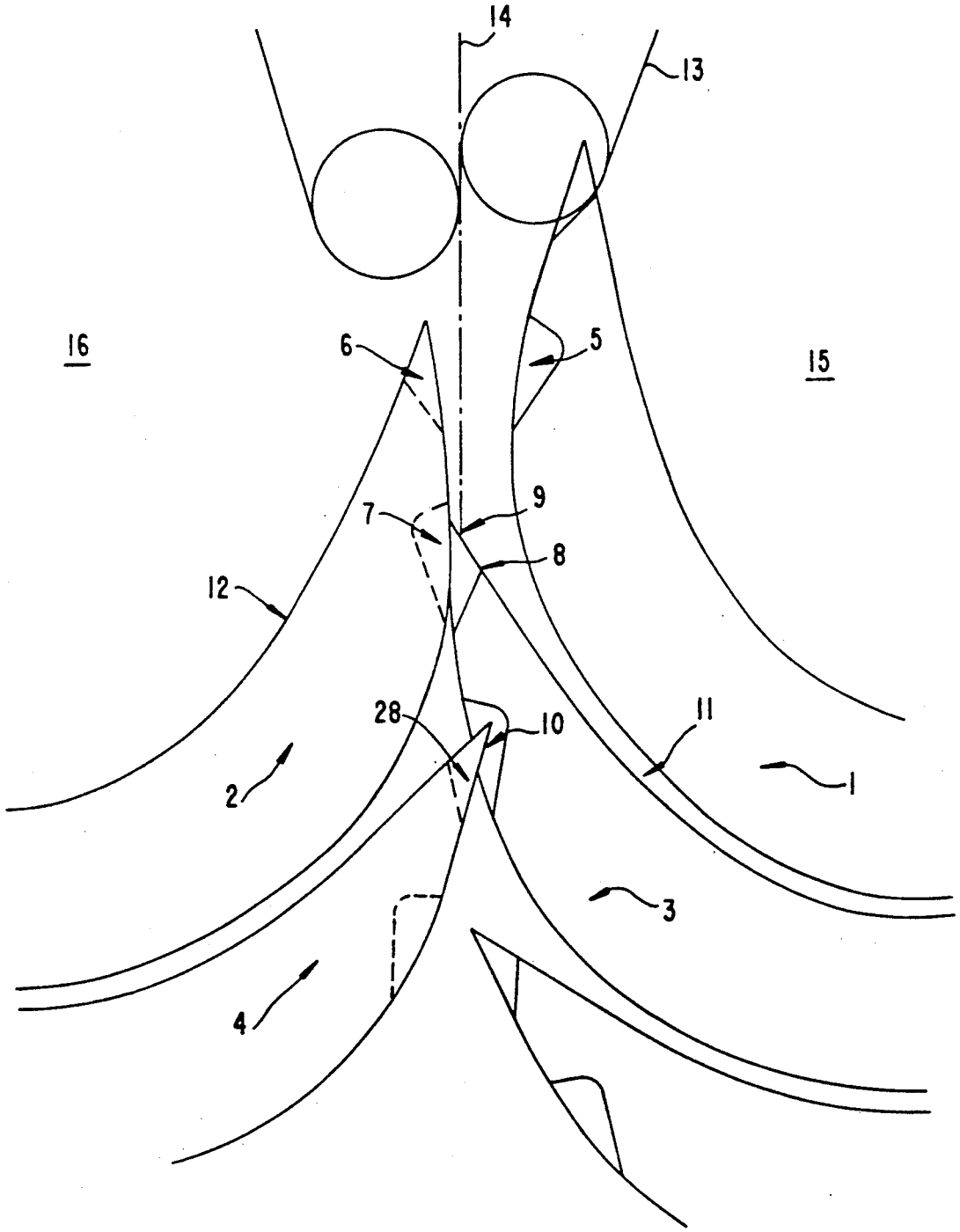
FIG. 2 is a much-enlarged fragmentary view of FIG. 1 showing part of a delivery system of the folder apparatus which includes two fan assemblies.

Referring now to the drawing and, first, more particularly to FIGS. 1 and 2 thereof, there is shown therein the transport path of a printed product.

One or more paper webs 14 are conducted over a former 24 and folded. After being folded, the paper web 14 is fed through nips of upper and lower draw rollers 23 and 22, respectively, and guide rollers 21 to a cutting cylinder 20, which severs the printed product from the paper web 14. A paper web separating device 25 is provided between the upper draw rollers 23 and the lower draw rollers 22

The cut and folded printed products are then fed by high-speed conveyor belts or transport tapes 13, which may also be formed as accelerators, to two fan assemblies or arrangements 17 and 18. The high-speed transport tapes 13 conduct the printed products to a location in the immediate vicinity of the respective fans 15 and 16 of the fan assemblies 17 and 18.

The cooperation of the respectively opposing fans 15 and 16 of the fan assemblies 17 and 18 is readily apparent from FIG. 2. A leading edge 9 of the printed product conveyed and suitably accelerated by the high-speed transport tapes 13 meets the fan blade 3, which is momentarily disposed in a position for receiving the printed product, in the vicinity of a tip 8 of the fan blade 3, and is displaced into a receiving pocket 11 formed by the two blades 1 and 3 of the respective fan 15. A tip 6 of the succeeding, oppositely disposed fan blade 2 deflects the printed-product flow from the vertically oncoming flow 14 of printed products into the direction of the fan blade 1, due to which also additional stabilization of the printed product occurs.

After the printed product has been fully received in the receiving pocket 11, the tip 6 of the fan blade 2, which had previously deflected and stabilized the printed product, dips into a recess 5 formed in the blade 1 following the receiving pocket 11.

The next printed product is then transported by the high-speed tapes 13 into the vicinity of the tip of the fan blade 2 which had previously caused the deflection of the printed product, and is moved completely into the receiving pocket 12 which is provided therefor. These steps are alternatingly repeated.

The printed product disposed in the receiving pockets 11 and 12 are slid out of the respective receiving pockets 11 and 12 by a conventional non-illustrated output stripper in a direction opposite to that in which they had been inserted into those receiving pockets and are deposited onto output conveyor belts 26 and 27.

Figure 3:
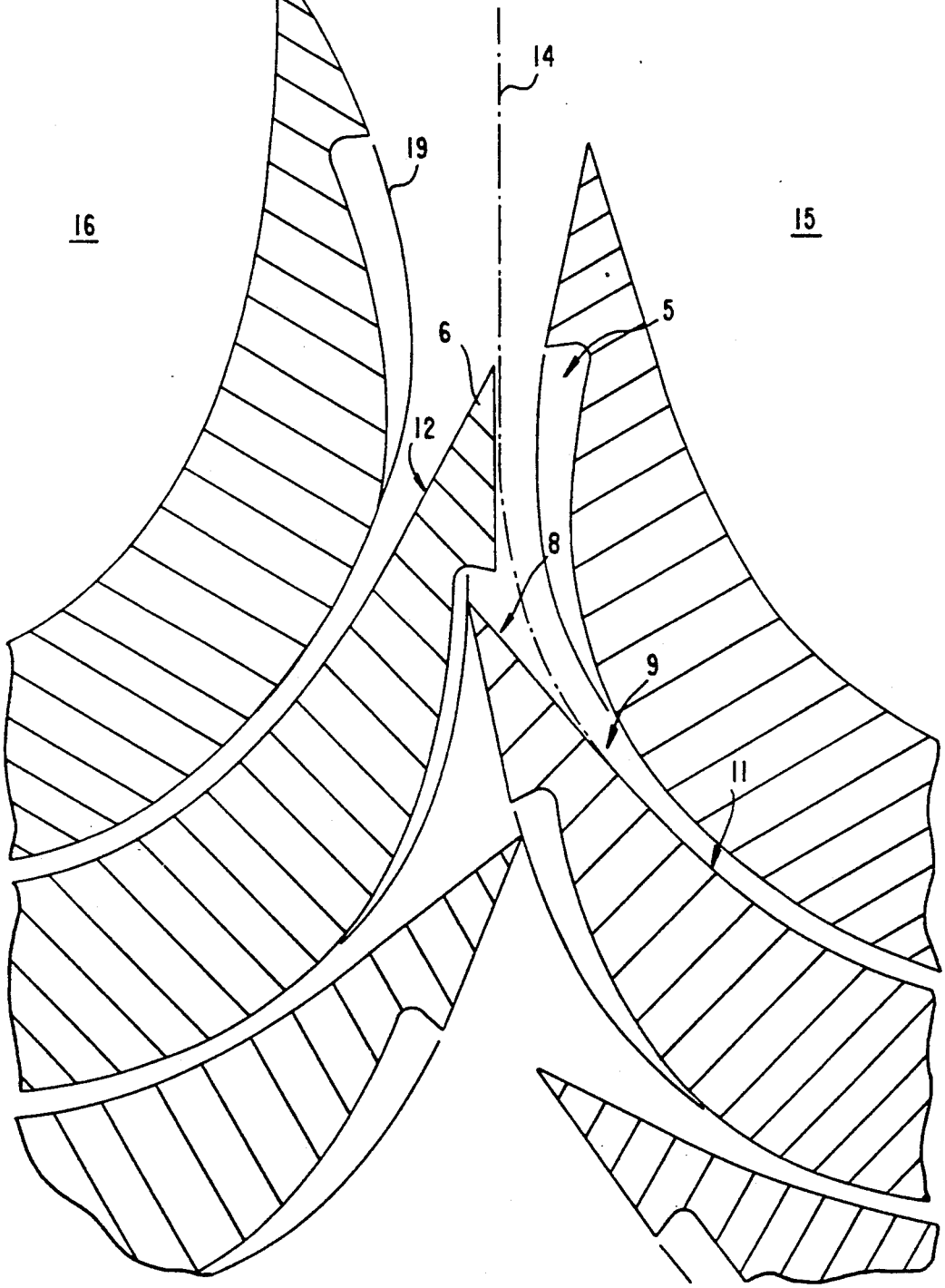
FIG. 3 is a view similar that of FIG. 2 of a second embodiment of the fan assemblies wherein the fans thereof are provided with springs.
Figure 5:
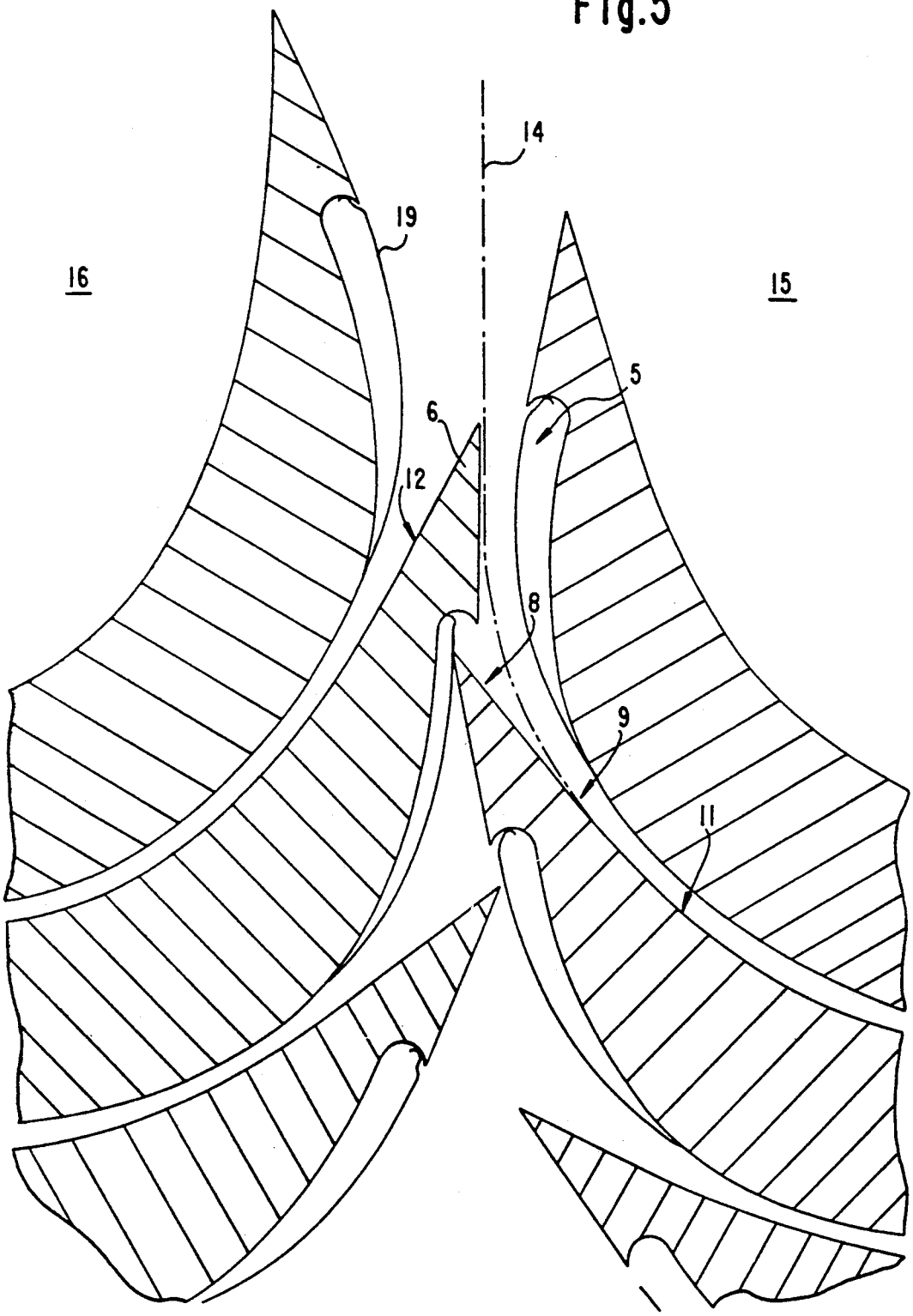
FIG. 5 is a view like that of FIG. 3, wherein the springs of the second embodiment of the invention have a modified construction.

In order to prevent possible collision of the printed product with the existing, substantially transverse wall of the respective recess 5, 7, 10, which can cause a blockage of the receiving pockets 11 and 12, a spring element or leaf spring 19, as shown in FIG. 3, is provided for covering the respective recess 5, 7, 10. Although not explicitly shown in the drawing, the spring element 19 is suitably connected at one end thereof to the respective blade 1 to 4 and, as shown in FIG. 3, is suitably prestressed so that, in the state thereof wherein it is not engaged by the point of an adjacent blade, it follows the contour of the blade to which it is attached. As shown in FIG. 5, the free end of the leaf spring element 19 is modified with a suitable bend formed therein so that it may catch or be received in a suitably undercut portion of the recess located at the end thereof of greater depth. This prevents the free end of the leaf spring element 19 from snagging on the printed product as it enters the receiving pocket.

Figure 4:
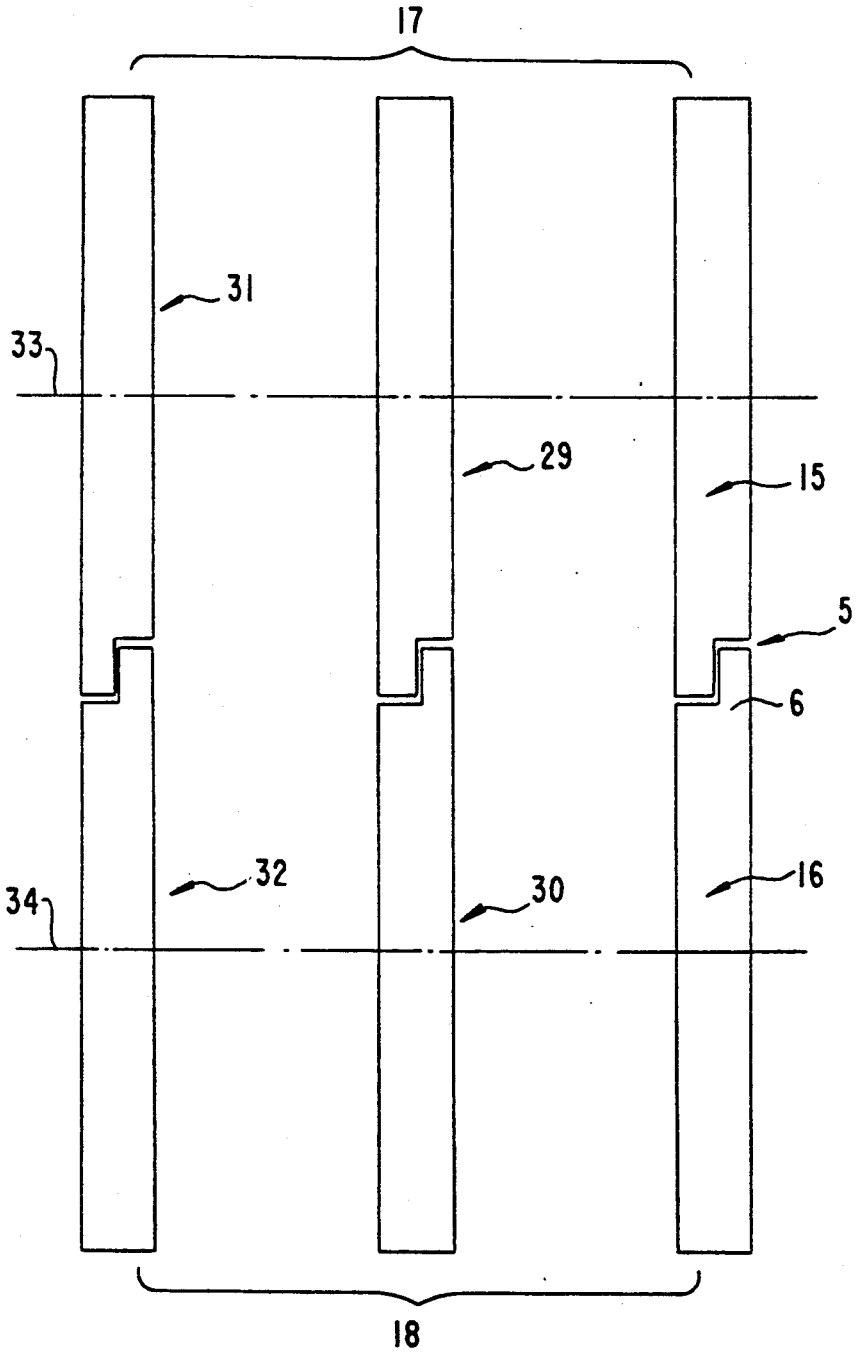
FIG. 4 is a diagrammatic end view of the fan assemblies.

Instead of a spring element 19, the respective blade 1 may be provided with a cutout or notch 5 (FIG. 2), which extends over only part of the thickness of the blade 1, as seen in FIG. 4, the tip 6 of the blade 2 located opposite thereto being, in turn, constructed i.e. undercut, in a similar manner (note FIG. 4), so that it can be received in the notch 5 of the blade 1 without collision with the defining walls of the notch 5. The lowermost rolls of the tapes 13 are disposed deeply between the fans 15,16 so as to afford a positive high-speed placement of the printed products or signatures into the fan pockets 11.

The juxtaposed fans 3 and 4 of the respective fan assemblies 17 and 18 are thus clearly shown in FIG. 4. Each of the pairs of juxtaposed fans 15, 16; 29, 30 and 31, 32 are shown clearly arranged in respective common planes extending perpendicularly into the plane of the drawing of FIG. 4. As more clearly shown in FIG. 2, the tip 28 of the fan blade 4 engages in the notch 10 of the fan blade 3. In the case wherein the notch 10 has a covering in the form of a resilient or spring element 19, as shown in FIG. 3, the fan blade 4 would simultaneously force the spring element 19 into the notch 10 as it i.e. the blade 4, dips into the notch 10

The fans 15, 16, 29, 30, 31 and 32 of the fan assemblies or arrangements 17 and 18, of which only the fans 15 and 16 are shown in FIG. 1, have a diameter of 36 inches in a given embodiment thereof and are preferably formed of molded plastic material. Of course, they may be formed of any other suitable material as well, and the pockets and notches may be formed of any suitable machining process. Due to the relatively large diameter of the fans, the receiving pockets 11 and 12 may be formed quite deep so that the printed product sliding into the receiving pocket 11 or 12 can travel back over a sufficiently long path on which, in turn, smooth braking, for example, by using a suitable slide retarding material, can be effected. A shock-absorbing or impact-damping element, such as foam material, for example, may additionally be applied to the end of the receiving pocket 11, 12, which finally and softly brakes the leading edge 9 of the printed product.

The leading edge 9 of the printed product which arrives at the end of the receiving pocket 11, 12 has a relatively slow peripheral speed, because the end of the receiving pocket 11, 12 lies near the center of the fan. The stationary stripping device, which is presented by the included broken lines above the conveyor belts 26 and 27 in FIG. 1, and which is supposed to slide the printed product again out of the receiving pocket 11, 12, thus collides with the leading edge 9 of the printed product at a slow speed so that no damage to the leading edge 9 is anticipated even if very thin printing paper is used. The stripping device may be disposed at suitable locations along the axes of the fans constituting each of the fan assemblies, those locations being in the spaces between individual fans of the respective fan assemblies.

Figure 6:
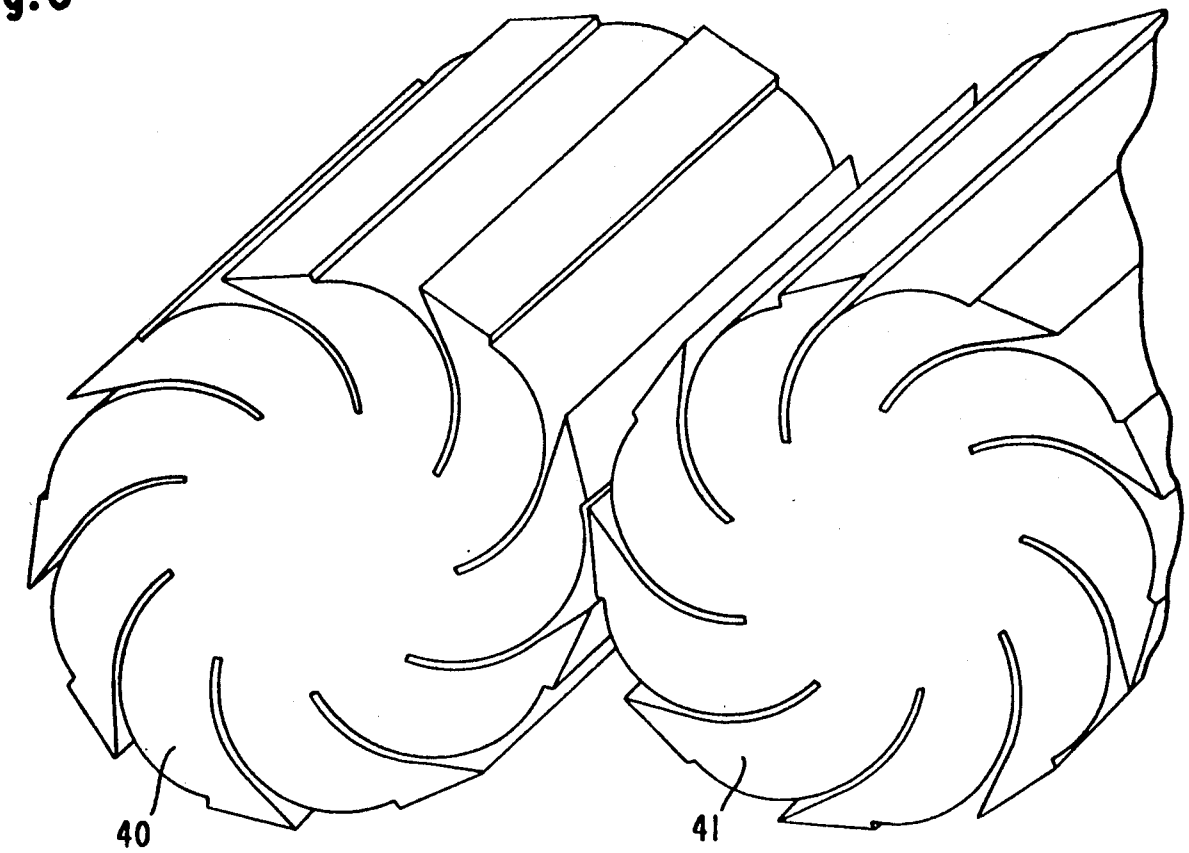
FIG. 6 is a diagrammatic perspective view of another embodiment of the fan assemblies, wherein each fan assembly has a substantially cylindrical configuration.

In FIG. 6, a third embodiment of the fan arrangements is shown, wherein each fan arrangement 40, 41 is, in substance, a cylinder formed with pockets between respective blades and, although not actually shown in the figure, suitable circumferential recesses may be formed in the surface of the substantially cylindrical fan arrangements to accommodate transport tapes and rollers, as well as strippers.

Figure 7:
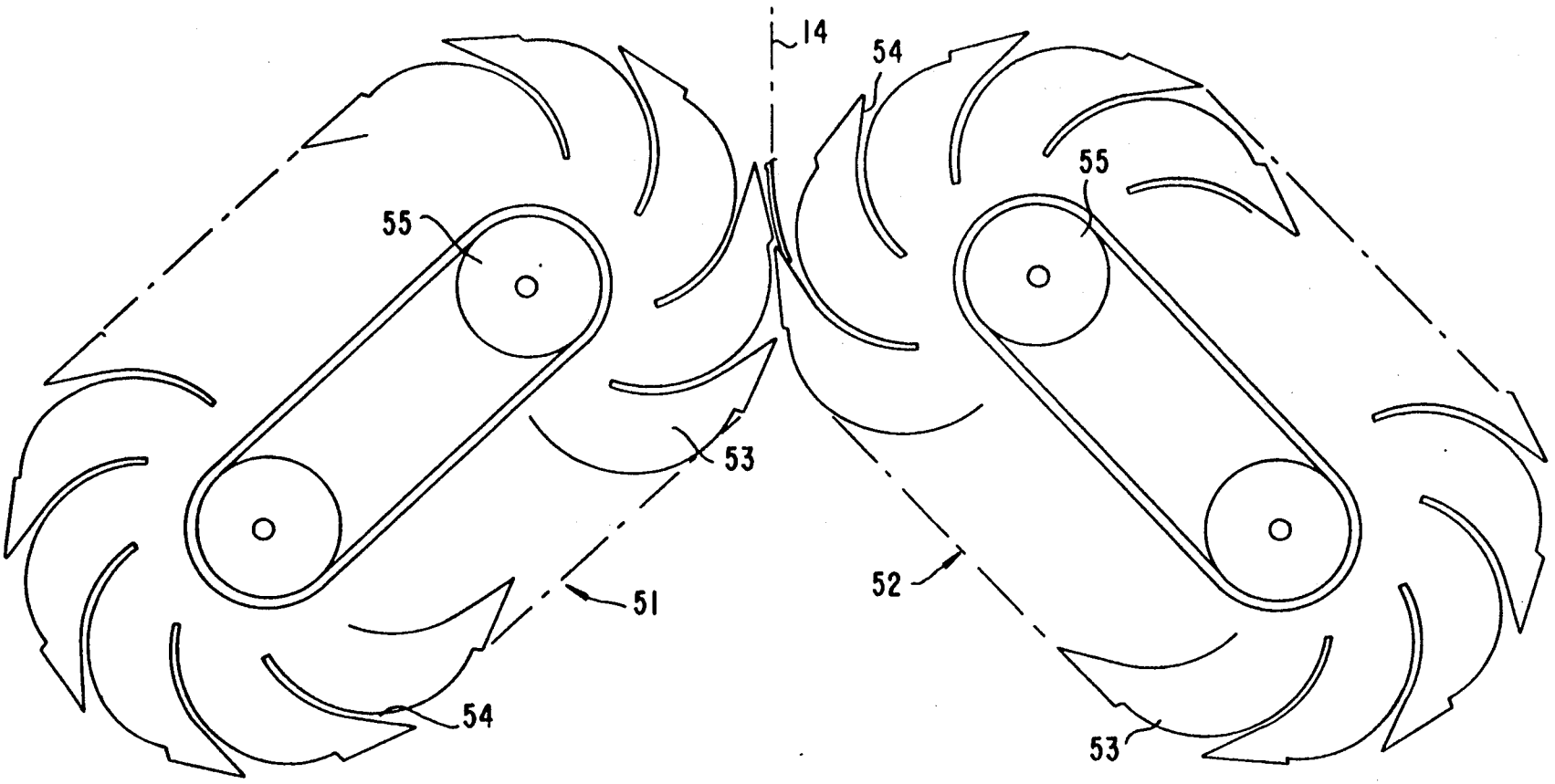
FIG. 7 is a diagrammatic elevational view of a fourth embodiment of the invention, wherein the delivery system includes assemblies formed as endless belts.

FIG. 7 illustrates diagrammatically a fourth embodiment of the invention wherein the fan assemblies are in the form of endless belts 51 and 52. Blades 53 formed with respective pockets therebetween are secured at selected spaced intervals along the respective endless belts 51 and 52, the alternating delivery of the printed products 14 to the respective pockets 54 of the two fan assemblies 51 and 52, the speed with which the respective drive sprockets 55 for the belts, as well as the spacing of the blades 53 along the endless belts 51 and 52, being controlling factors for slowing down the travel of the products 14. The blades 53 may be constructed like any of the blades in the aforedescribed embodiments of the invention.

Figure 8:
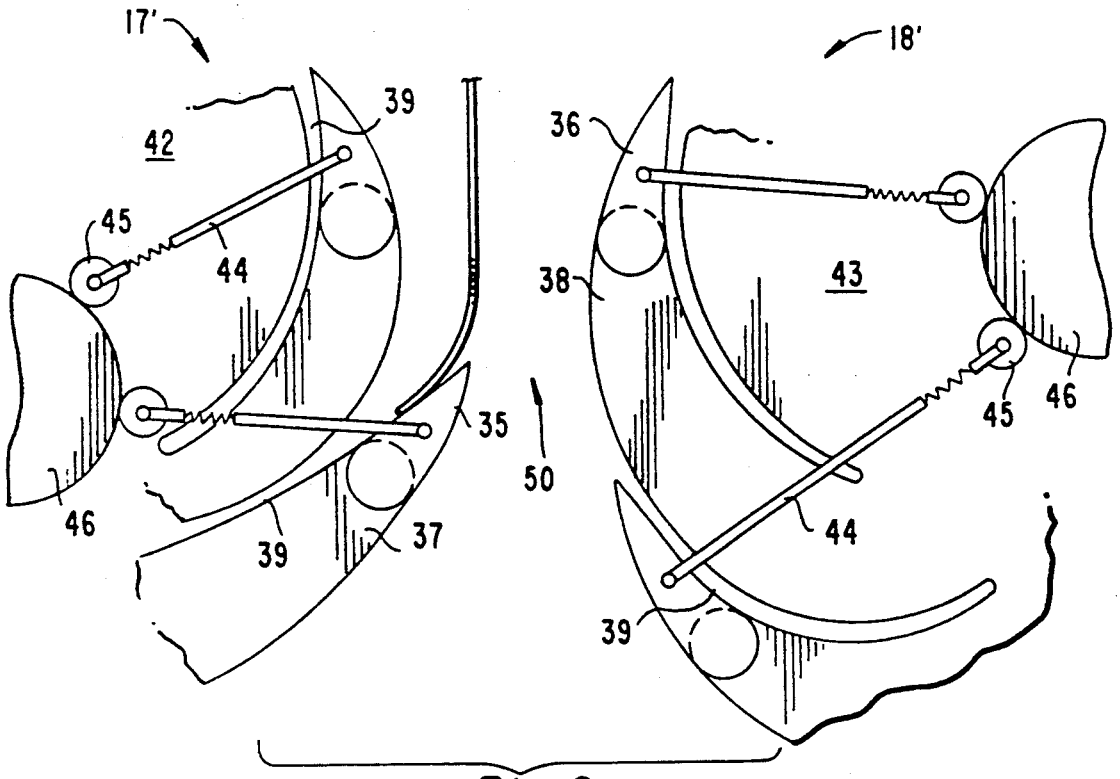
FIGS. 8 and 8*a* are views like those of FIGS. 3 and 4, respectively, of a fifth embodiment of the fan assemblies, wherein the fans have non-intersecting circumferences and extensible and retractable blade tips.

As shown in FIG. 8, the tips 35,36 of the blades 37,38, respectively, of the fans 42 and 43 of two fan arrangements 17' and 18' similar to those of FIGS. 2 and 3, for example, are, however, extensible to divert an oncoming printed product or signature into respective receiving pockets 39, and then retractable so as to avoid any possibility of a collision. In this regard, it is noted that the circumferences of the fan arrangements 17' and 18', in the retracted condition of the tips 35,36 of the fan blades 37,38 do not intersect i.e. there is a gap 50 between the fan arrangements 17' and 18' as viewed in the retracted condition of the blade tips 35 and 36. When the respective tips 35 of the blades 37 of the fan 42 have been extended, the respective tips 36 of the blades 38 of the fan 43 have been retracted, and vice versa. The tips 35 of the fan blades 37 cannot collide with the tips 36 of the fan blades 38 because neither set of tips of the respective fans 42 and 43 is permanently within the circle of action of the other.

Figure 8A:
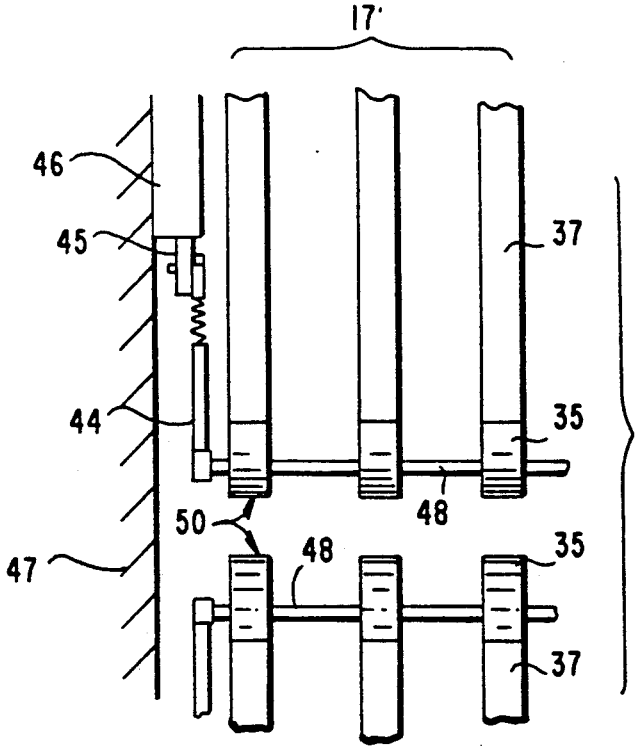

A suitable mechanism for effecting the extension and retraction of the tips 35,36 is illustrated diagrammatically in FIG. 8, and is made up of a linkage or push rod 44 pivotally connected at one end thereof to the respective pivotal end tip of the blades of those fans located at one side of the respective fan arrangements, the linkage 44 having a cam roller at the other end thereof which follows a suitably configured cam 46 fixed to a stationary side wall of the machine. As is shown in FIG. 8*a*, the respective tips of all of the fan blades disposed along the axes of the respective fan arrangements 17' and 18' are connected to one another so as to be extensible and retractable in unison in accordance with the action of the respective cam follower arrangement 44,45.

Of course, it is also possible to keep the tips 35 and 36 of all the blades 37 and 38 extended as the fans 42 and 43 revolve, in which case the thus formed circumferences of the fan arrangements 17' and 18' at the ends of the blade tips 35 and 36, respectively, would intersect. Consequently, only those tips, respectively, which must be retracted in order to avoid a collision at the intersecting location, would, in fact, be retracted by means of the cam follower arrangement 44,45 and a suitably configured cam 46, for example. The tips of the blades may also be formed with suitable recesses such as the recess 5, 7, 10 in the embodiment of FIG. 2, for example, in which case the tips of the blades of the fans 42 and 43 of FIG. 8 need not retract but may remain extended at the location at which they intersect, without collision.

I claim:

1. Folder apparatus of a web-fed printing press having a printed-product delivery with two fan arrangements, each of which is formed of a plurality of mutually adjacent fans spaced-apart from one another on a common axis, the respective common axis of each of the two fan arrangements being disposed parallel to the common axis of the other, each of the fans of one of the fan arrangements being disposed adjacent to and in a respective common plane with a respective one of the fans of the other of the fan arrangements, each of the fans being formed with blades having the tips located at a circumference of the respective fan, the circumferences of the fans in the respective common plane intersecting with one another, and means provided on the fans for preventing a collision of respective blade tips of the fans disposed in the respective common plane, the blades of the fans being formed with respective recesses at a radially outer region thereof, for receiving therein the tips of the blades of the fans disposed therewith in the respective common planes.

2. Folder apparatus according to claim 1, wherein said blades are formed with a given curvature, and said collision preventing means include a resilient covering for the respective recesses formed in the blades, said resilient covering having substantially the same curvature as the given curvature of the respective blades and being yieldable into the respective recesses.

3. Folder apparatus according to claim 2 wherein said resilient covering is a leaf spring element.

4. Folder apparatus according to claim 3 wherein each of said recesses has its greatest depth closest to a free end of the respective blade tip and is formed with an undercut portion thereat, said leaf spring element being fixed to the respective blade tip at a location of the respective recess farthest from the free end of the respective blade tip and having, in turn, a free end yieldingly received in said undercut portion of said recess.

5. Folder apparatus according to claim 1, wherein the respective recesses are formed in only one side of each of the respective blades of the fan, and the tip of each of the respective blades of the other fan is correspondingly formed so as to be accommodated in said recess.

6. Folder apparatus according to claim 5, wherein said recess has a depth which is a fraction of the thickness of said blade, and an outermost part of said tips of said blades has a reduced thickness substantially corresponding to said depth of said recess so as to afford a contact-free passage of said outermost part of said tips of said blades, respectively, through said recess.

7. Folder apparatus according to claim 6, wherein respective pairs of the blades of said fans define pockets therebetween for receiving printed products therein, and including means for successively feeding a stream of cut printed products directly to said fan assemblies, said feeding means comprising tape rollers carrying transport tapes and including lowermost tape rollers projecting downwardly into said fans for effecting a positive placement of the printed products into the respective pockets, said lowermost tape rollers being at locations laterally adjacent paths swept by said tip parts of reduced thickness during rotation of said fan assemblies.

8. Folder apparatus of a web-fed printing press having a printed-product delivery with two fan arrangements, each of which is formed of a plurality of mutually adjacent fans spaced-apart from one another on a common axis, the respective common axis of each of the two fan arrangements being disposed parallel to the common axis of the other, each of the fans of one of the fan arrangements being disposed adjacent to and in a respective common plane with a respective one of the fans of the other of the fan arrangements, each of the fans being formed with blades having tips located at a circumference of the respective fan, the circumferences of the fans in the respective common plane intersecting with one another, and means provided on the fans for preventing a collision of respective blade tips of the fans disposed in the respective common plane, said blades having a slide-resistant material thereon for braking an oncoming printed product.

9. Folder apparatus of a web-fed printing press having a printed-product delivery with two fan arrangements, each of which is formed of a plurality of mutually adjacent fans spaced apart from one another on a common axis, the respective common axis of each of the two fan arrangements being disposed parallel to the common axis of the other, each of the fans of one of the fan arrangements being disposed adjacent to and in a respective common plane with a respective one of the fans of the other of the fan arrangements, each of the fans being formed with blades having tips located at a circumference of the respective fan, the circumferences of the fans in the respective common plane intersecting with one another, and means provided on the fans for preventing a collision of respective blade tips of the fans disposed in the respective common plane, the tips of the blades of one of said fan arrangements being movable towards and away from the tips of the blades of the other of said fan arrangements.

10. In a folder apparatus of a web-fed printing press, a printed product delivery comprising two fan assemblies, respectively, formed of a rotatable body having a substantially cylindrical configuration; and means for successively delivering a stream of cut printed products in finished form directly to said fan assemblies, the rotatable bodies having respective rotational axes disposed parallel to and spaced from one another a distance less than the sum of the radii of the substantially cylindrically configured bodies so that a mutually overlapping region of the circumferences of said bodies is formed, each of said fan assemblies having a multiplicity of blades formed with respective curved surfaces defining elongated pockets therebetween for receiving printed products therein and being formed with respective tips extending into said overlapping region of said circumferences for diverting the printed products directly delivered in a given travel direction to said fan assemblies alternatingly at given instants of time into a pocket of the one fan assembly and into a pocket of the other fan assembly, said pockets at said given instants extending in said given travel direction arcuately from said tips to bottom ends thereof located adjacent respective centers of said rotatable bodies, and means formed on said fan assemblies for preventing the respective blade tips from colliding.

11. In a folder apparatus of a web-fed printing press, a printed product delivery comprising two fan assemblies, respectively, formed of a rotatable body having a substantially cylindrical configuration; and means for successively delivering a stream of cut printed products directly to said fan assemblies, the rotatable bodies having respective rotational axes disposed parallel to and spaced from one another a distance less than the sum of the radii of the substantially cylindrically configured bodies so that a mutually overlapping region of the circumferences of said bodies is formed, each of said fan assemblies having a mutliplicity of blades defining pockets therebetween for receiving printed products therein and being formed with respective tips extending into said overlapping region of said circumferences for diverting the printed products directly delivered to said fan assemblies alternatingly into a pocket of the one fan assembly and into a pocket of the other fan assembly, and means formed on said fan assemblies for preventing the respective blade tips from colliding, said blade tips being pivotally connected to said blades, and including means for alternatingly pivoting said blade tips, respectively, out of said mutually overlapping region of said circumferences so as to prevent collision between the respective blade tips of the respective fan assemblies.

12. A folder apparatus of a web-fed printing press having a printed product delivery comprising two fan assemblies, respectively, formed of a rotatable body having a substantially cylindrical configuration and having respective rotational axes extending in a longitudinal direction thereof, said axes being disposed parallel to one another, each of said fan assemblies being formed with a multiplicity of blades having tips located at a circumference of the respective fan assembly, each of said blades extending in said longitudinal direction over substantially the entire dimension of the respective rotational body, respective mutually adjacent pairs of said blades in circumferential direction of the respective fan assembly being formed with respective curved surfaces defining therebetween an elongated pocket extending arcuately from the respective tips to a bottom end of the pocket located adjacent a center of the rotational body for receiving a printed product in finished form therein, said rotational axes being spaced a distance from one another which is less than the sum of the radii of the cylindrical configured rotatable bodies so that said circumferences mutually intersect, said fan assemblies having means located beyond said pocket-defining surfaces for preventing the respective blade tips of said fans from colliding.

13. A folder apparatus of a web-fed printing press having a printed product delivery comprising two fan assemblies, respectively, formed of a rotatable body having a substantially cylindrical configuration and having respective rotational axes disposed parallel to one another, each of said fan assemblies being formed with a multiplicity of blades having tips located at a circumference of the respective fan assembly, respective mutually adjacent pairs of said blades defining therebetween a pocket for receiving a printed product therein, said rotational axes being spaced a distance from one another which is less than the sum of the radii of the cylindrical configured rotatable bodies so that said circumferences mutually intersect said fan assemblies having means for preventing the respective blade tips of said fans from colliding, slide-resistant material being disposed in said pockets for the printed product as to effect a braking of the printed product therein.

14. Folder apparatus of a web-fed printing press having a printed-product delivery with two fan arrangements, each of which is formed of a plurality of mutually adjacent fans spaced-apart from one another on a common axis, the respective common axis of each of the two fan arrangements being disposed parallel to the common axis of the other, each of the fans of one of the fan arrangements being disposed adjacent to and in a respective common plane with a respective one of the fans of the other of the fan arrangements, each of the fans being formed with blades having tips located at a circumference of the respective fan, the circumferences of the fans in the respective common plane intersecting with one another, and means provided on the fans for preventing a collision of respective blade tips of the fans disposed in the respective common plane, at least a portion of said tips of said blades being movably disposed on said blades, and including means for actuating said movable portion of said tips.

15. A folder apparatus for a web-fed printing press having a printed product delivery, comprising two assemblies, respectively, revolvable in opposite directions, and means for successively delivering a stream of cut printed products to said assemblies, said assemblies including respective receiving means formed with pockets defined by smoothly streamlined surfaces for respectively receiving one of the cut printed products therein, the respective receiving means of each of said assemblies being displaceable along respective endless paths as said assemblies revolve, said receiving means of both of said assemblies being on a collision course with one another so as to be collidable at a given location of said endless paths, and collision-preventing means comprising structures disposed on each of said assemblies and interrupting said smoothly streamlined surfaces for preventing a collision at said locations between said receiving means in one of said assemblies and said receiving means in the other of said assemblies.

16. Folder apparatus according to claim 15, wherein said assemblies comprise respective fan members, each formed of a rotatable body having a substantially cylindrical configuration.

17. Folder apparatus according to claim 15, wherein said assemblies comprise respective fan arrangements, each of which is formed of a plurality of mutually adjacent fans spaced from one another.

18. Folder apparatus according to claim 15, wherein said assemblies comprise respective endless belts.

19. A folder apparatus for a web-fed printing press having a printed product delivery, comprising two fan assemblies, respectively, formed with a plurality of fan blades having respective tips, said two fan assemblies being revolvable in opposite directions and including respective receiving means formed with pockets for receiving a printed product therein, the respective tips of the fan blades of each of said assemblies being displaceable along respective endless paths as said assemblies revolve, said blade tips of both of said assemblies being on a collision course with one another so as to be collidable at a given location of said endless paths, the blade tips of at least one of said two fan assemblies being yieldable to the blade tips of the other of said two fan assemblies for preventing jamming of the respective blade tips of said two fan assemblies at said location.

20. Folder apparatus according to claim 19, wherein said yieldable blade tips are formed of flexible material.

21. A folder apparatus of a web-fed printing press having a printed product delivery comprising two fan assemblies, respectively, formed of a rotatable body having a substantially cylindrical configuration and having respective rotational axes disposed parallel to one another, each of said fan assemblies being formed with a multiplicity of blades having tips located at a circumference of the respective fan assembly, respective mutually adjacent pairs of said blades having respective surfaces defining therebetween a pocket for receiving a printed product in finished form therein, said rotational axes being spaced a distance from one another which is greater by a given distance than the sum of the radii of the cylindrically configured rotatable bodies, and mechanical means operatable from a location beyond said blades and secured to said blade tips for alternatingly extending said blade tips of said fan assemblies a distance greater than half of said given distance so as to intercept an oncoming printed product and guide it into a respective pocket.

22. Folder apparatus of a web-fed printing press having a printed-product delivery with two fan arrangements, each of which is formed of a plurality of mutually adjacent fans spaced-apart from one another on a common axis, the respective common axes of said two fan arrangements being disposed substantially parallel to one another, and each of said fan arrangements having respective fans disposed adjacent to and in respective common planes with one another, each of said fans being formed with blades having respective blade portions proximal to said common axis and respective tips distal from said common axis and located at a circumference of the respective fans, the tips of the fan blades of said fan arrangements being movable with respect to said proximal blade portions into engagement by an oncoming printed product for diverting the printed product into a pocket formed between the respective blades of the respective fans.

* * * * *